US007750275B2

(12) United States Patent
Turner

(10) Patent No.: US 7,750,275 B2
(45) Date of Patent: Jul. 6, 2010

(54) FOLDING CONTROL SURFACE ASSEMBLY AND VEHICLE INCORPORATING SAME

(75) Inventor: Mark A. Turner, Arlington, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 1014 days.

(21) Appl. No.: 11/474,029

(22) Filed: Jun. 23, 2006

(65) Prior Publication Data

US 2008/0078859 A1 Apr. 3, 2008

(51) Int. Cl.
*F42B 15/01* (2006.01)

(52) U.S. Cl. ..... 244/3.27

(58) Field of Classification Search ..... 244/3.24, 244/3.27–3.29, 49
See application file for complete search history.

(56) References Cited

U.S. PATENT DOCUMENTS 4,460,137 A * 7/1984 Andersson et al. ..... 244/3.27
4,691,880 A * 9/1987 Frank ..... 244/49
5,820,072 A * 10/1998 Na et al. ..... 244/49
6,092,264 A * 7/2000 Banks ..... 16/321
7,552,892 B1 * 6/2009 Bittle et al. ..... 244/3.29
2007/0102567 A1 * 5/2007 Lee et al. ..... 244/3.24

* cited by examiner

*Primary Examiner*—Tien Dinh
(74) *Attorney, Agent, or Firm*—Davis Patent Services, LLC

(57) ABSTRACT

A folding control surface assembly includes a torsion shaft, a base, and a control surface hingedly attached to the base via the torsion shaft, such that the torsion shaft biases the control surface toward an unfolded configuration with respect to the base. A vehicle includes a body and at least one folding control surface assembly. The at least one folding control surface assembly includes a torsion shaft, a base attached to the body, and a control surface hingedly attached to the base via the torsion shaft, such that the torsion shaft biases the control surface toward an unfolded configuration with respect to the base.

32 Claims, 4 Drawing Sheets

101
103
105
107
108
109
111
113
114
115
117
119
201

FOLDING CONTROL SURFACE ASSEMBLY AND VEHICLE INCORPORATING SAME

BACKGROUND

1. Field of the Invention

The present invention relates to folding fin assemblies for airborne or waterborne vehicles.

2. Description of Related Art

Control surfaces, such as fins, wings, or the like, are often used to control the trajectory of an airborne or waterborne vehicle, such as a rocket, missile, torpedo, or the like. It is often desirable to fold such control surfaces prior to deploying the vehicle, so that the vehicle occupies a smaller volume in a launch tube or a barrel. Once deployed from the launch tube or barrel, however, the control surfaces are unfolded to operational configurations, so that the vehicle's trajectory may be controlled.

It is very desirable to maximize the amount of propellant and/or payload of such a vehicle. The vehicle's radial diameter, however, is limited to an inner diameter of the launch tube or barrel from which the vehicle is deployed. Conventional folding control surface assemblies typically use torsion springs to bias the control surfaces from folded, stowed configurations to unfolded, operational configurations. Such torsion springs, however, are bulky and, thus, significantly contribute to the radial diameter of the vehicle. Accordingly, torsion springs occupy volumes within the launch tube or barrel that could more beneficially be occupied by increased propellant and/or payload of the vehicle.

There are many designs of folding control surface assemblies well known in the art, however, considerable shortcomings remain.

SUMMARY OF THE INVENTION

There is a need for an improved, folding control surface assembly.

Therefore, it is an object of the present invention to provide an improved, folding control surface assembly.

This and other objects are achieved by providing a folding control surface assembly, including a torsion shaft, a base, and a control surface hingedly attached to the base via the torsion shaft, such that the torsion shaft biases the control surface toward an unfolded configuration with respect to the base.

In another aspect of the present invention, a folding control surface assembly is provided. The folding control surface assembly includes a torsion shaft, a base, and a control surface. The folding control surface assembly further includes a first torsion shaft pin attaching a first end of the torsion shaft to the control surface and a second torsion shaft pin slidably attaching a second end of the torsion shaft to the base. The control surface is hingedly attached to the base via the torsion shaft and the torsion shaft biases the control surface toward an unfolded configuration with respect to the base.

In yet another aspect, the present invention provides a vehicle including a body and at least one folding control surface assembly. The at least one folding control surface assembly includes a torsion shaft, a base attached to the body, and a control surface hingedly attached to the base via the torsion shaft, such that the torsion shaft biases the control surface toward an unfolded configuration with respect to the base.

The present invention provides significant advantages, including: (1) providing a folding control surface assembly that occupies a smaller volume than conventional assemblies that employ torsion springs; and (2) providing a vehicle that is smaller in radial diameter than conventional vehicles employing torsion spring control surface folding mechanisms.

Additional objectives, features and advantages will be apparent in the written description which follows.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, in which the leftmost significant digit(s) in the reference numerals denote (s) the first figure in which the respective reference numerals appear, wherein:

Figure 1:
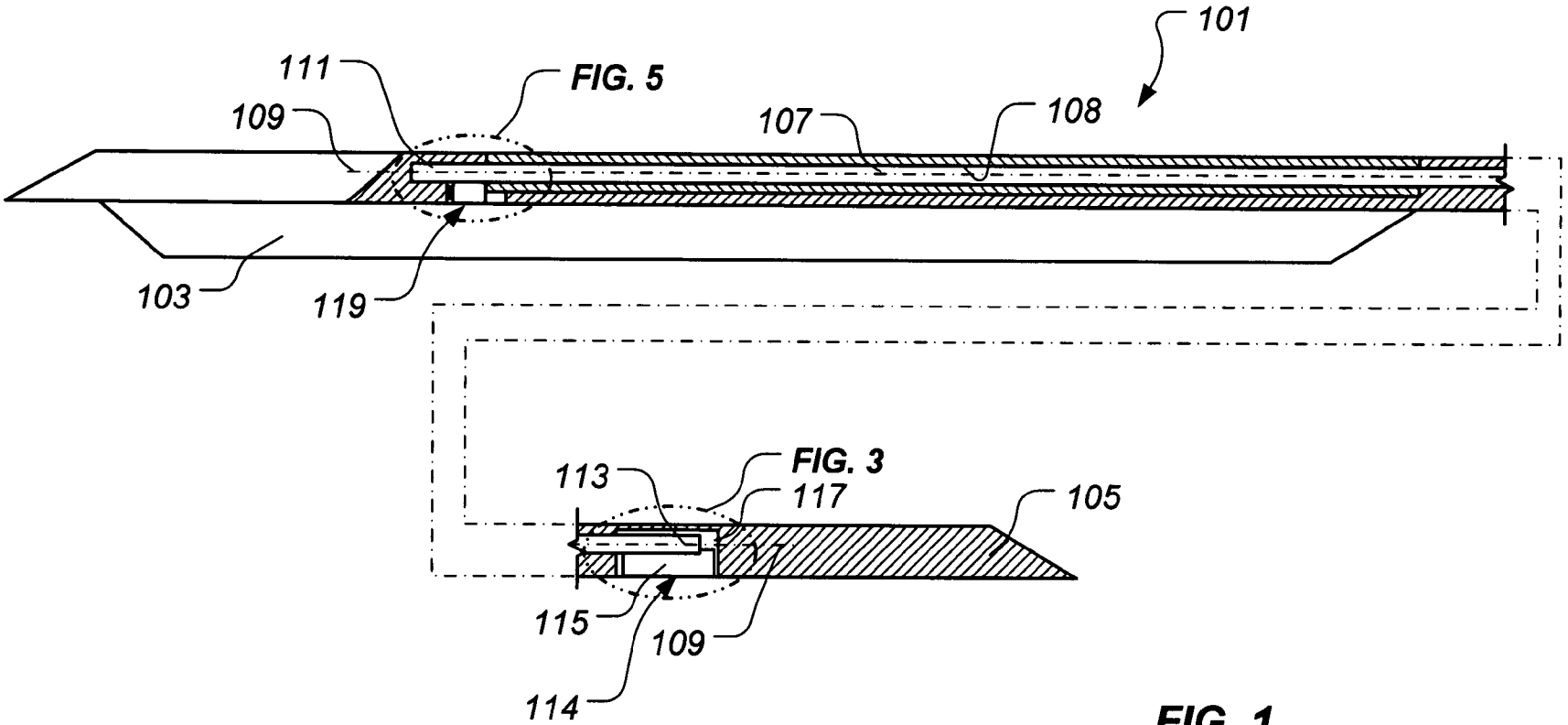
FIG. 1 is a partial cross-sectional view of an illustrative embodiment of a folding control surface assembly according to the present invention, depicted in a folded, stowed configuration.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention represents a folding control surface assembly. The folding control surface assembly comprises a torsion shaft about which a control surface hinges and by which the control surface is biased from a folded, stowed configuration to an unfolded, operational configuration. The torsion shaft occupies much less volume than a torsion spring while providing sufficient motive force to bias the control surface toward the operational configuration.

Figures 2, 4, 6:
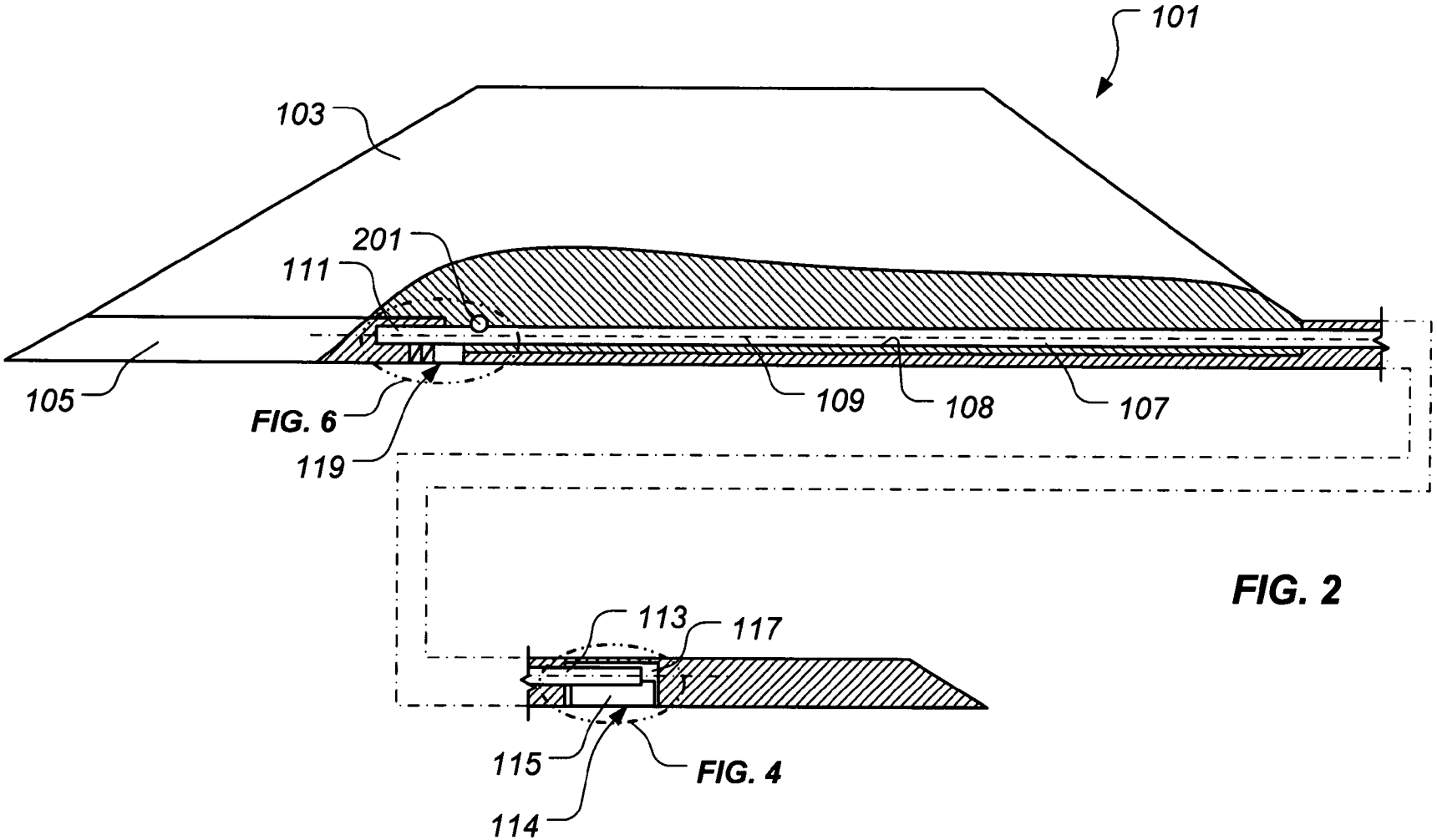
FIG. 2 is a partial cross-sectional view of the folding control surface assembly of FIG. 1, depicted in an unfolded, operational configuration.
FIG. 4 is an enlarged, partial cross-sectional view of the sliding torsion shaft lock of FIG. 3, depicted in a relaxed configuration.
FIG. 6 is an enlarged, partial cross-sectional view of the control surface lock of FIG. 5, depicted in a locked configuration.

FIG. 1 depicts a partial cross-sectional view of an illustrative embodiment of a folding control surface assembly 101 according to the present invention in a folded, stowed configuration. FIG. 2 depicts a partial cross-sectional view of folding control surface assembly 101 in an unfolded, operational configuration. Folding control surface assembly 101 is configured to be incorporated into a vehicle, e.g., a rocket, a missile, a torpedo, or the like, capable of airborne or waterborne travel. Folding control surface assembly 101 comprises a control surface 103, a base 105, and a torsion shaft 107.

Figure 7:
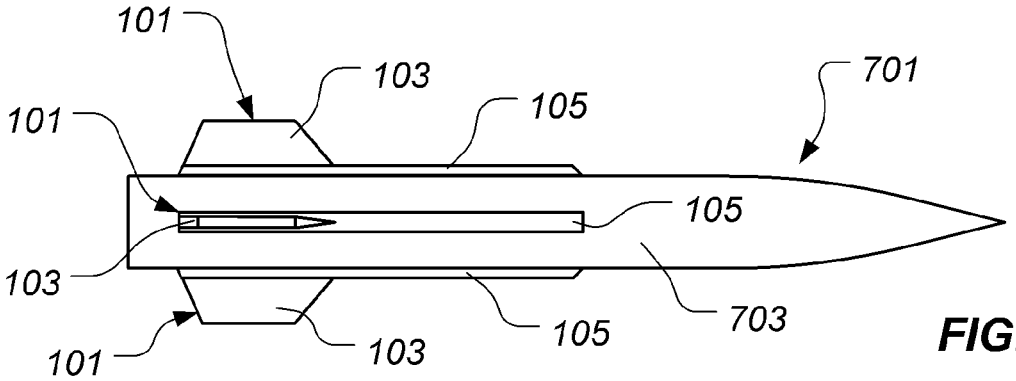
FIG. 7 is a stylized, side, elevational view of an illustrative embodiment of a vehicle incorporating the folding control surface assembly of FIG. 1.

Still referring to FIGS. 1 and 2, control surface 103 is a structure, such as a fin, a wing, or the like, that is operable to aerodynamically or hydrodynamically control a trajectory of a vehicle, such as vehicle 701 of FIG. 7. Control surface 103 is hingedly attached to base 105 via torsion shaft 107. Thus, control surface 103 hinges about a central axis 109 of torsion shaft 107 with respect to base 105 from the folded, stowed configuration of FIG. 1 to the unfolded, operational configuration of FIG. 2. In the illustrated embodiment, torsion shaft 107 extends from base 105, through a bore 108 defined by control surface 103, to base 105.

Torsion shaft 107 also biases control surface 103 from the folded, stowed configuration of FIG. 1 toward the unfolded, operational configuration of FIG. 2. Torsion shaft 107 is affixed proximate a first end 111 to control surface 103 via a first torsion shaft pin 201 (not shown in FIG. 1). In the illustrated embodiment, torsion shaft 107 defines a recess 501 and control surface 103 defines a bore 502 (each shown in FIGS. 5 and 6). First torsion shaft pin 201 is received in recess 501 and bore 502 to secure control surface 103 to torsion shaft 107. Torsion shaft 107 is affixed proximate a second end 113 to base 105 via a sliding torsion shaft lock 114. Thus, torsion shaft 107 is twisted or torqued about central axis 109 when control surface assembly 101 is in the folded, stowed configuration. When a vehicle (e.g., vehicle 701 of FIG. 7) is deployed, potential energy stored in torsion shaft 107 is converted into kinetic energy to bias control surface 103 toward the unfolded, operational configuration of FIG. 2. In a preferred embodiment, control surface 103 is held in the folded, stowed configuration by a vehicle canister, dunnage, or the like, although other means for retaining control surface 103 in the folded, stowed configuration are possible.

According to the present invention, torsion shaft 107 may comprise any material and have configuration (e.g., diameter, length, etc.) that will allow torsion shaft 107 to elastically twist or torque about central axis 109 sufficiently to bias control surface 103 from the folded, stowed position to the unfolded, operational position. In one embodiment, torsion shaft 107 comprises a super-elastic material (e.g., a super-elastic nickel-titanium alloy, such as Nitinol), exhibits a diameter of about 4.8 mm, and exhibits a length of about 54 cm. Note, however, that the scope of the present invention is not limited by this example. The particular composition and configuration of torsion shaft 107 is implementation specific. For example, torsion shaft 107 may comprise a high-strength steel. Torsion shaft 107 may take on the form of a solid rod or a tube. Torsion shaft 107 preferably exhibits sufficient mechanical properties to only substantially reversibly deform when twisted or torqued about central axis 109 to place control surface 103 in the folded, stowed position.

For example, in embodiments wherein torsion shaft 107 comprises a super-elastic material, torsion shaft 107 deforms reversibly via the creation of a stress-induced metallurgical phase. When the load is removed (i.e., when torsion shaft 107 urges control surface 103 to the unfolded, operational position), the stress-induced phase becomes unstable and torsion shaft 107 regains its original shape. In one embodiment, torsion shaft 107 comprises a substantially austenitic structure when relaxed, i.e., when control surface 103 is in the unfolded, operational configuration. When control surface 103 is moved to the folded, stowed position, at least a portion of torsion shaft 107 is transformed to a martensitic structure. When control surface 103 is released to the unfolded, operational configuration, the martensitic structure becomes unstable, transforming to an austenitic structure.

Figure 3:
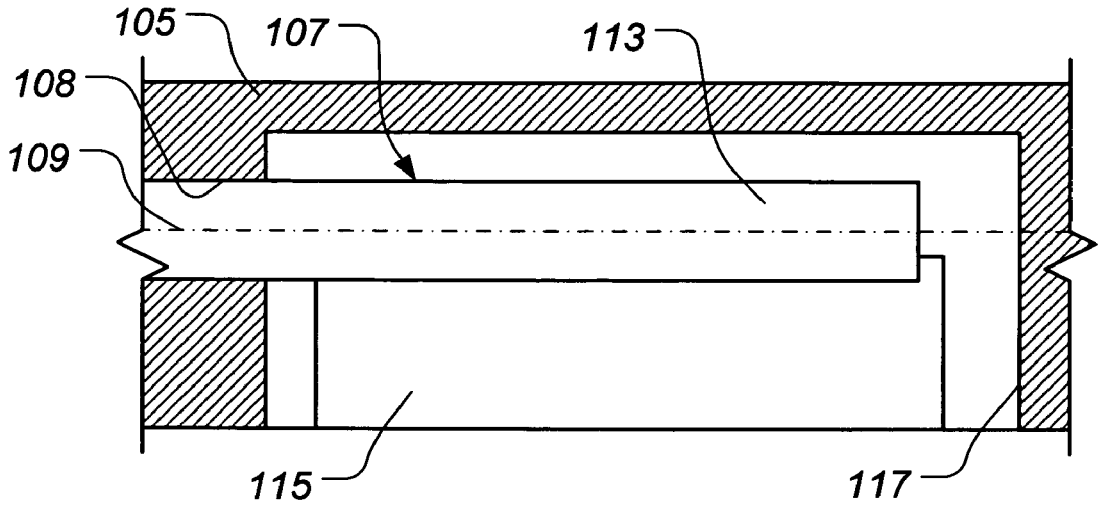
FIG. 3 is an enlarged, partial cross-sectional view of an illustrative embodiment of a sliding torsion shaft lock of the folding control surface assembly of FIG. 1, depicted in a biasing configuration.
Figure 4:
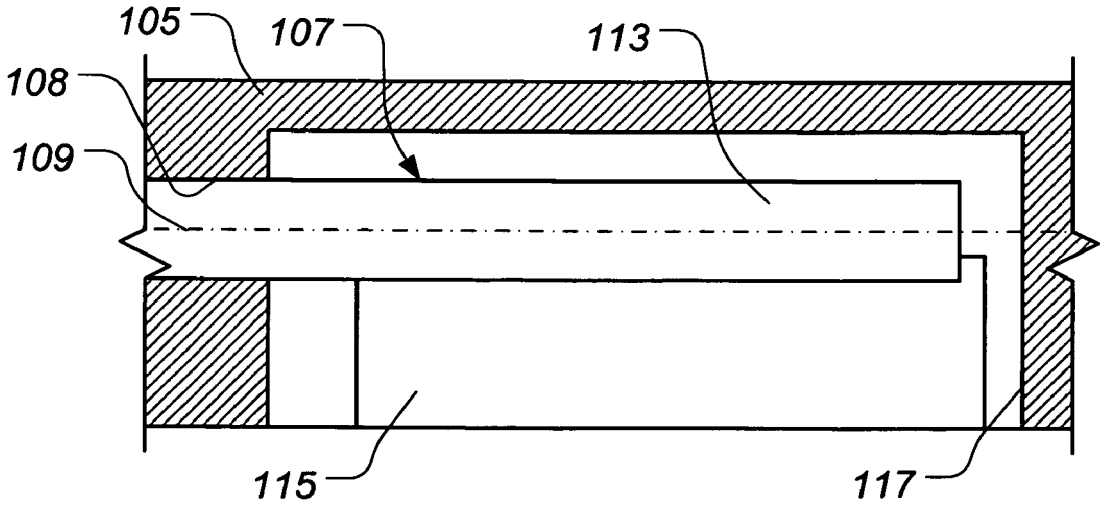

FIGS. 3 and 4 provide enlarged, partial cross-sectional views of a particular illustrative embodiment of sliding torsion shaft lock 114, which comprises a second torsion shaft pin 115 disposed in a slot 117 defined by base 105. In particular, FIGS. 3 and 4 illustrate the sliding nature or compliance of second torsion shaft pin 115 in slot 117. FIG. 3 illustrates an exemplary position of second torsion shaft pin 115 in slot 117 when control surface assembly 101 is in the folded, stowed configuration and FIG. 4 illustrates an exemplary position of second torsion shaft pin 115 in slot 117 when control surface assembly 101 is in the unfolded, operational configuration. Generally, torsion shaft 107 becomes shorter in length generally along central axis 109 as torsion shaft 107 is twisted or torqued about central axis 109. Conversely, as the potential energy is released from torsion shaft 107 (i.e., as control surface 103 is biased to the unfolded, operational position), torsion shaft 107 becomes longer in length. Accordingly, slot 117 is sized to allow second torsion shaft pin 115 to extend and retract generally in a direction along central axis 109. In other words, second torsion shaft pin 115 is free to move in directions generally along central axis 109 to compensate for the changing length of torsion shaft 107 as torsion shaft 107 is twisted or torqued about central axis 109. Second torsion shaft pin 115, however, does not substantially rotate in slot 117.

It should be noted, however, that second torsion shaft pin 115 and slot 117 are but one means for accommodating changes in length of torsion shaft 107. Other means are contemplated by, and thus encompassed by, the present invention. It should also be noted that sliding torsion shaft lock 114 can be operatively associated with torsion shaft 107 proximate first end 111 and that control surface 103 can be affixed to torsion shaft 107 at any suitable location, such as distal from first end 111.

Figure 5:
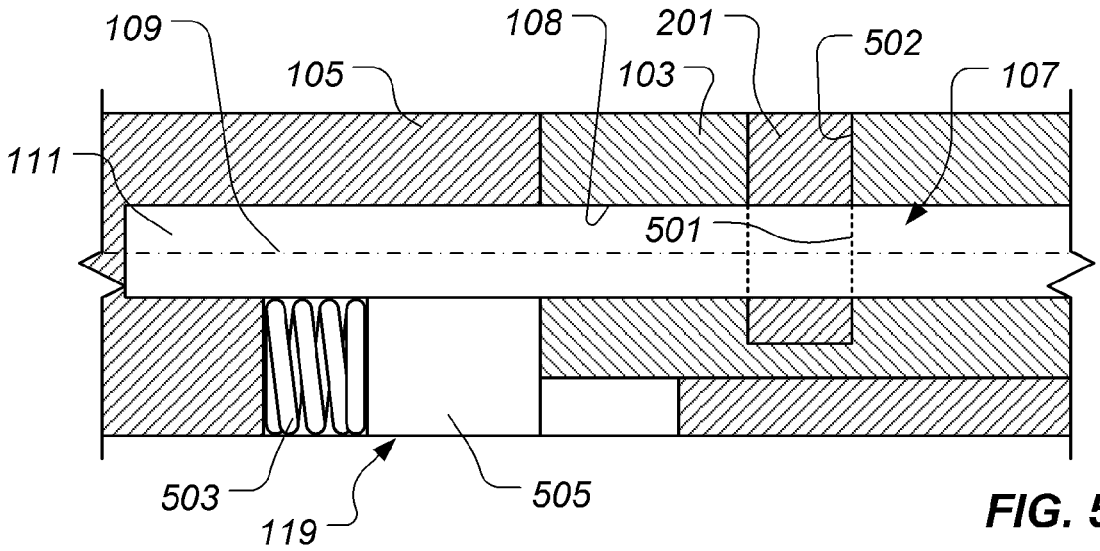
FIG. 5 is an enlarged, partial cross-sectional view of an illustrative embodiment of a control surface lock of the folding control surface assembly of FIG. 1, depicted in an unlocked configuration.
Figure 6:
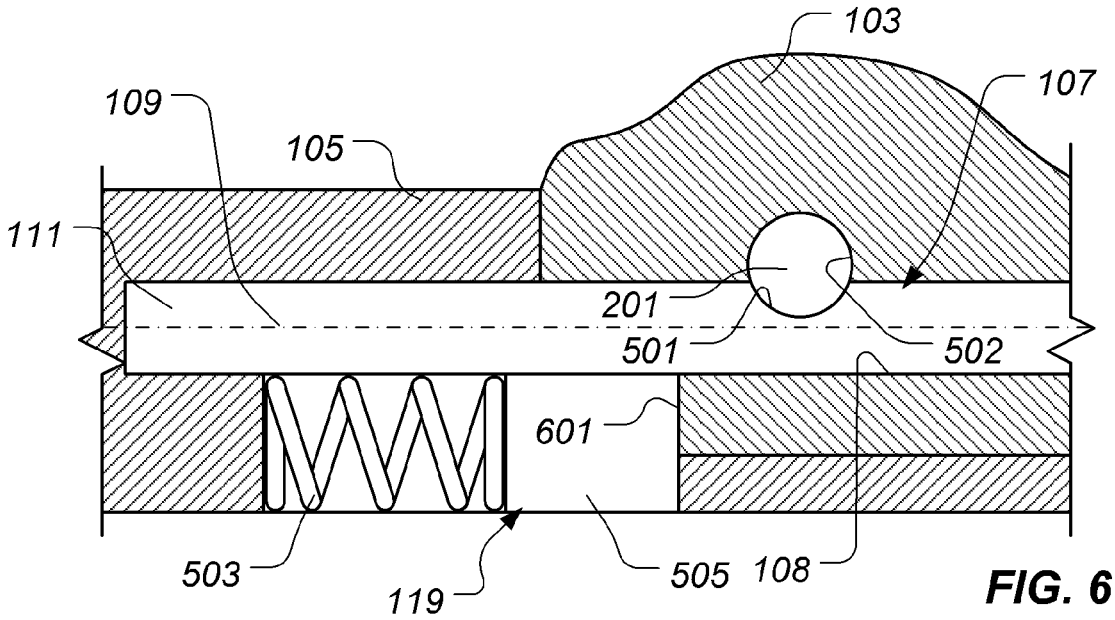

FIGS. 5 and 6 provide enlarged, partial cross-sectional views of a portion of control surface assembly 101, depicting an illustrative embodiment of a control surface lock 119 according to the present invention. Control surface lock 119 comprises, in the illustrated embodiment, a locking pin 505 and a biasing element 503. In the illustrated embodiment, biasing element 503 comprises a helical spring. When control surface 103 is in the folded, stowed configuration, as illustrated in FIG. 5, locking pin 505 abuts control surface 103 but allows control surface 103 to hinge about central axis 109 toward the unfolded, operational configuration. When control surface 103 achieves the unfolded, operational configuration, as shown in FIG. 6, biasing element 503 urges locking pin 505 into a recess 601 defined by control surface 103. The engagement of locking pin 505 into recess 601 retains control surface 103 in the unfolded, operational configuration.

It should be noted, however, that control surface lock 119 is but one means for retaining control surface 103 in the unfolded, operational configuration. Other implementations of the means for retaining control surface 103 in the unfolded, operational configuration are contemplated by, and thus encompassed by, the present invention.

FIG. 7 depicts an illustrative embodiment of vehicle 701, according to the present invention, incorporating at least one control surface assembly 101 of FIG. 1. In the illustrated embodiment, vehicle 701 comprises four control surface assemblies 101 (only three control surface assemblies 101 shown in FIG. 7). The scope of the present invention, however, is not so limited. Rather, vehicle 701 may comprise any suitable number of control surface assemblies 101, such as three control surface assemblies 101. It should also be noted that bases 105 may be recessed into a body 703 of vehicle 701.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. A folding control surface assembly, comprising:
a torsion shaft;
a base defining a slot;
a control surface hingedly attached to the base via the torsion shaft, such that the torsion shaft biases the control surface toward an unfolded configuration with respect to the base; and
a second torsion shaft pin affixed to the torsion shaft and received in the slot, such that the slot defined by the base and the second torsion shaft pin accommodates changes in length of the torsion shaft.

2. The folding control surface assembly, according to claim 1, further comprising:
means for retaining the control surface in an unfolded configuration.

3. The folding control surface assembly, according to claim 2, wherein the means for retaining the control surface in an unfolded configuration comprises:
a recess defined by the control surface;
a locking pin; and
a biasing element operably associated with the locking pin for urging the locking pin into the recess.

4. The folding control surface assembly, according to claim 1, further comprising:
a first torsion shaft pin affixing a first end of the torsion shaft to the control surface; and
a second torsion shaft pin slidably affixing a second end of the torsion shaft to the base.

5. The folding control surface assembly, according to claim 1, wherein the torsion shaft comprises:
a super-elastic material.

6. The folding control surface assembly, according to claim 5, wherein the super-elastic material is a nickel-titanium alloy.

7. The folding control surface assembly, according to claim 1, wherein the torsion shaft is a rod.

8. The folding control surface assembly, according to claim 1, wherein the torsion shaft is a tube.

9. A folding control surface assembly, comprising:
a torsion shaft;
a base
a control surface
a first torsion shaft pin attaching a first end of the torsion shaft to the control surface; and
a second torsion shaft pin slidably attaching a second end of the torsion shaft to the base;
wherein the control surface is hingedly attached to the base via the torsion shaft and the torsion shaft biases the control surface toward an unfolded configuration with respect to the base.

10. The folding control surface assembly, according to claim 9, further comprising:
a control surface lock operably associated with the control surface and the base.

11. The folding control surface assembly, according to claim 9, wherein the torsion shaft comprises:
a super-elastic material.

12. The folding control surface assembly, according to claim 11, wherein the super-elastic material is a nickel-titanium alloy.

13. The folding control surface assembly, according to claim 9, wherein the torsion shaft is a rod.

14. The folding control surface assembly, according to claim 9, wherein the torsion shaft is a tube.

15. A vehicle, comprising:
a body; and
at least one folding control surface assembly operably associated with the body, the at least one folding control surface assembly comprising:
a torsion shaft;
a base attached to the body, the base defining a slot;
a control surface hingedly attached to the base via the torsion shaft, such that the torsion shaft biases the control surface toward an unfolded configuration with respect to the base; and
a second torsion shaft pin affixed to the torsion shaft and received in the slot, such that the slot and the second torsion shaft pin accommodate changes in length of the torsion shaft.

16. The vehicle, according to claim 15, further comprising:
means for retaining the control surface in an unfolded configuration.

17. The vehicle, according to claim 16, wherein the means for retaining the control surface in an unfolded configuration comprises:
a recess defined by the control surface;
a locking pin; and
a biasing element operably associated with the locking pin for urging the locking pin into the recess.

18. The vehicle, according to claim 15, further comprising:
a first torsion shaft pin affixing a first end of the torsion shaft to the control surface; and
a second torsion shaft pin slidably affixing a second end of the torsion shaft to the base.

19. A folding control surface assembly, comprising:
a torsion shaft;
a base
a control surface hingedly attached to the base via the torsion shaft, such that the torsion shaft biases the control surface toward an unfolded configuration with respect to the base;

a first torsion shaft pin affixing a first end of the torsion shaft to the control surface; and a second torsion shaft pin slidably affixing a second end of the torsion shaft to the base.

20. The folding control surface assembly, according to claim 19, further comprising:

means for accommodating changes in length of the torsion shaft.

21. The folding control surface assembly, according to claim 20, wherein the means for accommodating changes in length of the torsion shaft comprises:

a slot defined by the base; and a second torsion shaft pin affixed to the torsion shaft and received in the slot.

22. The folding control surface assembly, according to claim 19, further comprising:

means for retaining the control surface in an unfolded configuration.

23. The folding control surface assembly, according to claim 22, wherein the means for retaining the control surface in an unfolded configuration comprises:

a recess defined by the control surface;

a locking pin; and a biasing element operably associated with the locking pin for urging the locking pin into the recess.

24. The folding control surface assembly, according to claim 19, wherein the torsion shaft comprises:

a super-elastic material.

25. The folding control surface assembly, according to claim 24, wherein the super-elastic material is a nickel-titanium alloy.

26. The folding control surface assembly, according to claim 19, wherein the torsion shaft is a rod.

27. The folding control surface assembly, according to claim 19, wherein the torsion shaft is a tube.

28. A vehicle, comprising:

a body; and at least one folding control surface assembly operably associated with the body, the at least one folding control surface assembly comprising:

a torsion shaft;

a base attached to the body;

a control surface hingedly attached to the base via the torsion shaft, such that the torsion shaft biases the control surface toward an unfolded configuration with respect to the base;

a first torsion shaft pin affixing a first end of the torsion shaft to the control surface; and a second torsion shaft pin slidably affixing a second end of the torsion shaft to the base.

29. The vehicle, according to claim 28, further comprising:

means for accommodating changes in length of the torsion shaft.

30. The vehicle, according to claim 29, wherein the means for accommodating changes in length of the torsion shaft comprises:

a slot defined by the base; and a second torsion shaft pin affixed to the torsion shaft and received in the slot.

31. The vehicle, according to claim 28, further comprising:

means for retaining the control surface in an unfolded configuration.

32. The vehicle, according to claim 31, wherein the means for retaining the control surface in an unfolded configuration comprises:

a recess defined by the control surface;

a locking pin; and a biasing element operably associated with the locking pin for urging the locking pin into the recess.

* * * * *